United States Patent [19]

Gilman et al.

[11] Patent Number: 4,643,780

[45] Date of Patent: Feb. 17, 1987

[54] METHOD FOR PRODUCING DISPERSION STRENGTHENED ALUMINUM ALLOYS AND PRODUCT

[75] Inventors: Paul S. Gilman, Suffern; Stephen J. Donachie, New Windsor, both of N.Y.

[73] Assignee: INCO Alloys International, Inc., Huntington, W. Va.

[21] Appl. No.: 664,058

[22] Filed: Oct. 23, 1984

[51] Int. Cl.[4] ..... C22F 1/04

[52] U.S. Cl. ..... 148/12.7 A; 148/11.5 A; 148/11.5 P; 148/415; 148/440

[58] Field of Search ..... 148/12.7 A, 11.5 A, 148/11.5 P, 415, 440

[56] References Cited

U.S. PATENT DOCUMENTS

| | | | |
|---|---|---|---|
| 3,591,362 | 7/1971 | Benjamin | 75/0.5 BA |
| 3,740,210 | 6/1973 | Bomford et al. | 75/0.5 AC |
| 3,816,080 | 6/1974 | Bomford et al. | 75/0.5 AC |
| 4,292,079 | 9/1981 | Pickens et al. | 75/232 |
| 4,297,136 | 10/1981 | Pickens et al. | 75/234 |
| 4,409,038 | 10/1983 | Weber | 148/12.7 A |

OTHER PUBLICATIONS

Metal Handbook, 8th Ed., vol. 5 (1970), pp. 127–132.

*Primary Examiner*—R. Dean

*Attorney, Agent, or Firm*—Raymond J. Kenny; Miriam W. Leff

[57] ABSTRACT

A process for obtaining forged low density aluminum alloys having high strength comprising control of the extrusion and forging conditions, and dispersion strengthened Al-Mg-Li alloys derived from such process.

19 Claims, 2 Drawing Figures

METHOD FOR PRODUCING DISPERSION STRENGTHENED ALUMINUM ALLOYS AND PRODUCT

TECHNICAL FIELD

The present invention relates to dispersion strengthened aluminum-base alloys, and more particularly to a method of producing forged "mechanically alloyed" aluminum alloy systems having improved mechanical properties.

BACKGROUND OF THE INVENTION

In recent years there has been an intensive search for high strength aluminum which would satisfy the demands of advanced design in aircraft, automotive, naval and electrical industries. While high strength is a key characteristic of the materials sought, to meet the qualifications for certain advanced design applications the alloys must meet a combination of property requirements such as density, strength, ductility, toughness, fatigue and corrosion resistance, depending on the ultimate end use of the materials. The complexity of the problem goes far beyond the difficulties of developing materials with suitable combinations of properties not achieved before. Economics also plays a large role in the choice of materials. The ultimate product forms are often complex shapes, and the potential savings resulting from possible composition substitution is only a part of the picture. The new aluminum alloys would be particularly valuable if they could be shaped into desired forms using cost effective techniques such as forging while retaining their preshaped properties and/or if they could be fabricated economically into the same complex shapes now used with other materials so as to eliminate the need for retooling for fabrication of weight saving structures. Moreover, to be commercially useful, the fabricated parts must have reproducible properties. From a vantage point of commercial viability, the reproducibility will be attainable under a practical range of conditions.

The use of powder metallurgy routes to produce high strength aluminum has been proposed and has been the subject of considerable research. Powder metallurgy techniques generally offer a way to produce homogenous materials, to control chemical composition and to incorporate dispersion strengthening particles into the alloy. Also, difficult-to-handle alloying elements can at times be more easily introduced by powder metallurgy than ingot melt techniques. The preparation of dispersion strengthened powders having improved properties by a powder metallurgy technique known as mechanical alloying has been disclosed, e.g., in U.S. Pat. No. 3,591,362 (incorporated herein by reference). Mechanically alloyed materials are characterized by fine grain structure which is stabilized by uniformly distributed dispersoid particles such as oxides and/or carbides. U.S. Pat. Nos. 3,740,210, 3,816,080 (incorporated herein by reference) pertain particularly to the preparation of mechanically alloyed dispersion strengthened aluminum. Other aspects of mechanically alloyed aluminum-base alloys have been disclosed in U.S. Pat. Nos. 4,292,079, 4,297,136 and 4,409,038.

For most uses a powder must be fabricated into a final product, e.g, by degassing, compaction, consolidation and shaping in one or more steps. To obtain complex parts the fabrication may take the form, e.g., of extruding, forging and machining. Usually, the less machining required to make a part the greater the economy in material use, labor and time. It will be appreciated that it is an advantage to be able to make a complex shape by forging rather than by a route which requires the shaping by manual labor on an individual basis.

It is academic that composition of an alloy often dictates the fabrication techniques that can be used to manufacture a particular product. In general, the target properties which must be attained in the type aluminum alloys of this invention before other properties will be considered are strength, density and ductility. One of the marked advantages of mechanically alloyed powders is that they can be made into materials having the same strength and ductility as materials made of similar compositions made by other routes, but with a lower level of dispersoid. This enables the production of alloys which can be fabricated more easily without resorting to age hardening additives. While the mechanical alloying route produces materials that are easier to fabricate than other aluminum alloys of comparable composition, the demands for strength and low density and the additives used to obtain higher strength and/or lower density usually decrease workabilty of the alloy system. (Workability takes into account at least ductility at the working temperature and the load necessary to form the material.) The extent of the effect is generally related to the level of additive in the alloy. The additives not only affect the method by which the material can be fabricated, but also the fabrication techniques affect the properties of the materials.

It has now been found that low density dispersion strengthened, mechanically alloyed aluminum-lithium-magnesium alloys can be fabricated into forged parts characterized by improved strength along with adequate ductility by extruding and forging the alloys under controlled narrow conditions. It has further been found that controlling the extrusion of the materials under specific conditions makes possible a wider range of conditions under which the materials can be forged. This further enhances the commercial value of the alloys and improves the reproducibility of the forged parts. It has also been found that the temperatures at which the alloys should be forged are in a lower range than would be expected from normal handbook practice for forging aluminum alloys, e.g., as described in the Metals Handbook, 8th Ed., Vol. 5 (1970) on pp. 127–132.

SUMMARY OF THE INVENTION

Figure 1:
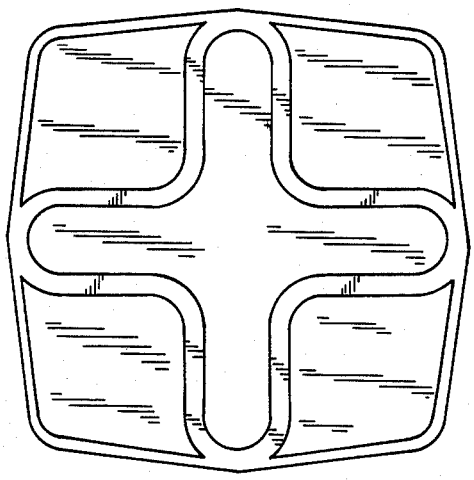
FIG. 1 is a plan drawing of a "Cruciform"-type forging.

The present invention is directed to a method for obtaining a forged product composed of a dispersion strengthened, low density aluminum-base alloy comprised of, aluminum, lithium and magnesium, said alloy being derived from a powder of said alloy prepared by a mechanical alloying process, and said method for obtaining the forged product being comprised of a sequence of steps comprising: degassing and compacting said powder under vacuum to obtain a compaction billet having a density sufficiently high to obtain an extruded billet of substantially full density; extruding the resultant compaction billet at a temperature in the range of above the incipient extrusion temperature up to about 400° C. (750° F.) said extrusion being carried out with lubrication through a conical die to provide an extruded billet of substantially full density; and forging the resultant extruded billet said resultant billet being subjected to at least a first forging treatment at a temperature in the range of about 230° C. (450° F.) up to about 400° C. (750° F.), with the proviso that for maximizing strength the forging is carried out at the lower end of the forging temperature range when the extrusion is carried out at the higher end of the extrusion temperature range.

Degassing is carried out at a temperature higher than any temperature to be subsequently experienced by the alloy, and compaction is carried out at least to the extent that the porosity is isolated, and preferably to at least about 95% of full density and higher.

By incipient extrusion temperature is meant the lowest temperature at which a given alloy can be extruded on a given extrusion press at a given extrusion ratio. The extrusion ratio is at least 3:1 and may range, for example, to about 20:1 and higher.

By a conical die is meant a die in which the transition from the extrusion liner to the extrusion die is gradual. Advantageously the angle of the head of the die with the liner is less than about 60°, and preferably it is about 45°.

Alloys of the present invention consist essentially of, by weight, about 0.5 to about 4% Li, about 0.5 to about 7% Mg, a small but effective amount for increased strength, e.g. about 0.05%, up to about 5% carbon, a small but effective amount for increased strength and stability up to about 1% oxygen, and the balance essentially aluminum, and having a dispersoid content of a small but effective amount for increased strength up to about 10 volume % dispersoid.

In a preferred embodiment of the present process the alloys contain about 1.5% up to about 2.5% lithium and about 2% up to about 4% magnesium, 0.5% to about 1.2% carbon and up to less than 1% oxygen, and the extrusion is carried out at a temperature in the range of about 230° C. (450° F.) to about 400° C. (750° F.). Advantageously the extrusion is carried out below about 370° C. (700° F.), preferably in the range of about 260° C. (500° F.) to about 360° C. (675° F.), and most preferably at about 260° C. (500° F.). For this alloy system, the forging operation (or in a multi-step forging operation the initial forging step) is carried out at a temperature of about 230° C. (450° F.) to about 400° C. (750° F.) when extrusion is carried out at about 260° C., and the forging operation (or initial forging step) is carried out at a narrow range at the lower end of the extrusion temperature range, e.g. at about 260° C. (500° F.) when extrusion is previously carried out at 370° C. (700° F.). In accordance with the present invention low density alloys of such system can be provided which are characterized by an 0.2% offset yield strength (YS) of at least 410 MPa (60 ksi), an elongation of at least 3%. In one aspect of the invention the Al-Li alloys have a density of less than 2.57 g/cm$^3$.

DETAILED ASPECTS OF THE INVENTION

(A) Composition

The essential components of the matrix of the alloy systems of the present invention are aluminum, magnesium and lithium and the alloys are characterized in that they are dispersion strengthened, they are formed from mechanically alloyed powders into forged articles. The dispersion strengthening agents comprise carbides and oxides.

Carbon and oxygen along with small amounts of magnesium and lithium are present as a small weight percentage of the alloy system in combination as insoluble dispersoids such as oxides and/or carbides. Other elements may be incorporated in the alloy so long as they do not interfere with the desired properties of the alloy for a particular end use. Also, a minor amount of impurities may be picked up from the charge materials or in preparing the alloy. Additional insoluble, stable dispersoids or dispersoid forming agents may be incorporated in the system, e.g., for strengthening of the alloy at elevated temperatures, so long as they do not otherwise adversely affect the alloy.

Unless otherwise specified, concentration of components is given in weight %.

The lithium level in the alloys may range, for example, from about 0.5 to about 4%, advantageously in an amount of about 1 up to about 3%, and preferably from about 1.5 or 1.6 up to about 2.5%. The lithium is introduced into the alloy system as a powder (elemental or preferably prealloyed with aluminum) thereby avoiding problems which accompany the melting of lithium in ingot metallurgy methods. Magnesium may be present, for example, in an amount of about 0.5% to about 7%. Advantageously, the magnesium level may range from above 1 up to about 5%, preferably it is about 2 up to about 4 or 4.5%. Exemplary alloys contain above 1.5 up to about 2.5% lithium and about 2 to about 4.5% magnesium.

Carbon is present in the system at a level ranging from a small but effective amount for increased strength up to about 5%. Typically the level of carbon ranges from about 0.05 up to about 2%, advantageously from about 0.2% up to about 1% or 1.5%, preferably about 0.5 up to about 1.2%. The carbon is generally provided by a process control agent during the formation of the mechanically alloyed powders. Preferred process control agents are methanol, stearic acid, and graphite. In general the carbon present will form carbides, e.g. with one or more of the components of the system.

Oxygen is usually present in the system, and it is usually desirable at a very low level. In general, oxygen is present in a small but effective amount for increased strength and stability, e.g., about 0.05% up to 1%, and preferably, it does not exceed about 0.4 or 0.5%. As disclosed in a co-pending application U.S. Ser. No. 521,060 the low oxygen content is believed to be critical. When the oxygen content is above 1% the alloy is found to have poor ductility. In alloys containing above 1.5% Li, the oxygen content preferably does not exceed about 0.5%.

It will be appreciated that the alloys may contain other elements which when present may enhance certain properties and in the amounts in which they are present do not adversely affect the alloy of a particular end use.

The dispersoid comprises oxides and carbides present in a range of a small but effective amount for increased strength up to about 10 volume % (vol. %) or even higher. Preferably the dispersoid level is as low as possible consistent with desired strength. Typically the dispersoid level is about 1.5 to 7 vol. %. Preferably it is about 2 to 6 vol. %. The dispersoids may be present, for example, as an oxide of aluminum, lithium, or magnesium or combinations thereof. The dispersoid can be formed during the mechanical alloying step and/or later consolidation and thermomechanical processing. Possibly they may be added as such to the powder charge. Other dispersoids may be added or formed in-situ so long as they are stable in the aluminum alloy matrix at the ultimate temperature of service. Examples of dispersoids that may be present are $Al_2O_3$, AlOOH, $Li_2O$, $Li_2Al_2O_4$, $LiAlO_2$, $LiAl_5O_8$, $Li_5AlO_4$ and MgO. The dispersoids may be carbides, e.g. $Al_4C_3$. Intermetallics may also be present.

In a preferred alloy system the lithium content is about 1.5 up to about 2.5%, the magnesium content is about 2 up to about 4%, the carbon content is about 0.5 to about 2%, and the oxygen content is less than about 0.5%, and the dispersoid level is about 2 or 3 to 6 volume %. For example, the alloys may be comprised of: Al-4Mg-1.5Li-1.2C, Al-5Mg-1Li-1.1C, Al-4Mg-1.75Li-1.1C, Al-2Mg-2Li-1.1C, Al-2Mg-2.5Li-1.1C, Al-4Mg-2.5Li-0.7C and Al-2Mg-2.5Li-0.7C.

(B) Alloy Preparation Prior to Fabrication (1) Mechanical Alloying to Form Powders Powder compositions treated in accordance with the present invention are all prepared by a mechanical alloying technique. This technique is a high energy milling process, which is described in the aforementioned patents incorporated herein by reference. Briefly, aluminum powder is prepared by subjecting a powder charge to dry, high energy milling in the presence of a grinding media, e.g. balls, and a process control agent, under conditions sufficient to comminute the powder particles to the charge, and through a combination of comminution and welding actions caused repeatedly by the milling, to create new, dense composite particles containing fragments of the initial powder materials intimately associated and uniformly interdispersed. Milling is done in a protective atmosphere, e.g. under an argon or nitrogen blanket, thereby facilitating oxygen control since virtually the only sources of oxygen are the starting powders and the process control agent. The process control agent is a weld-controlling amount of a carbon-contributing agent and may be, for example, graphite or a volatilizable oxygen-containing hydrocarbon such as organic acids, alcohols, heptanes, aldehydes and ethers. The formation of dispersion strengthened mechanically alloyed aluminum is given in detail in U.S. Pat. Nos. 3,740,210 and 3,816,080, mentioned above. Suitably the powder is prepared in an attritor using a ball-to-powder weight ratio of 15:1 to 60:1. As indicated above, preferably process control agents are methanol, stearic acid, and graphite. Carbon from these organic compounds and/or graphite is incorporated in the powder and contributes to the dispersoid content.

(2) Degassing and Compaction

Before the dispersion strengthened mechanically alloyed powder is consolidated it must be degassed and compacted. Degassing and compacting are effected under vacuum and generally carried out at a temperature in the range of about 480° C. (895° F.) up to just below incipient liquefication of the alloy. As indicated above, the degassing temperature should be higher than any subsequently experienced by the alloy. Degassing is preferably carried out, for example, at a temperature in the range of from about 480° C. (900° F.) up to 545° C. (1015° F.) and more preferably above 500° C. (930° F.). Pressing is carried out at a temperature in the range of about 545° C. (1015° F.) to about 480° C. (895° F.).

In a preferred embodiment the degassing and compaction are carried out by vacuum hot pressing (VHP). However, other techniques may be used. For example, the degassed powder may be upset under vacuum in an extrusion press. To enable the powder to be extruded to substantially full density, compaction should be such that the porosity is isolated, thereby avoiding internal contamination of the billet by the extrusion lubricant. This is achieved by carrying out compaction to at least 85% of full density, advantageously above 95% density, and preferably the material is compacted to over 99% of full density. Preferably the powders are compacted to 99% of full density and higher, that is, to substantially full density.

The resultant compaction products formed in the degassing and compaction step or steps are then consolidated.

(C) Fabrication (1) Consolidation

Consolidation in the present process is carried out by extrusion. The extrusion of the material not only is necessary to insure full density in the alloy, but also to break up surface oxide on the particles. The extrusion temperature is critical and within a narrow range. The lubrication practice and the conical die-type equipment used for extrusion are also important.

The extrusion temperature is chosen so that the maximum temperature achieved in the extruder is no greater than 10° C. (50° F.) below the solidus temperature. Typically it will be in the range of about 230° C. (450° F.) and about 400° C. (750° F.). Advantageously, it should be carried out below about 370° C. (700° F.) and should not exceed about 345° C. (650° F.). Preferably it should be lower than about 330° C. (625° F.). The temperature should be high enough so that the alloy can be pushed through the die at a reasonable pressure. Typically this will be above about 230° C. (450° F.). It has been found that a temperature of about 260° C. (500° F.) for extrusion is highly advantageous. By carrying out the extrusion at about 260° C. (500° F.), there is the added advantage of greater flexibility in conditions which may be used during the forging operation. This flexibility decreases at the higher end of the extrusion temperature range.

The above given extrusion temperature ranges which must be used for the Al-Li-Mg are those which will maximize the strength of the alloy since strength is currently the initial screening test for the forged parts made from the aluminum-base alloys. It will be appreciated that when the strength requirements are not as rigorous the teachings of this invention can be used to trade-off strength against some other property.

The extrusion in the present process is carried out in a conical-faced die as defined above, as opposed to a shear-faced die. Lubrication is applied to the die or the compaction billet or both of them. The lubricants, which aid in the extrusion operation, must be compatible with the alloy compaction billet and the extrusion press, e.g. the liner and die. The lubricant applied to the billet further protects the billet from the lubricant applied to the extrusion press.

Properly formulated lubricants for specific metals are well known in the art. Such lubricants take into account, for example, requirements to prevent corrosion and to make duration of contact of the billet with the extrusion press less critical. Examples of lubricants for the billets are kerosene, mineral oil, fat emulsion and mineral oil containing sulfurized fatty oils. Fillers such as chalk, sulfur and graphite may be added. An example of a lubricant for an extrusion press is colloidal graphite carried in oil or water, molydisulfide, boron sulfide, and boron nitride.

The extruded billets are then in condition to be forged. If necessary the billets may be machined to remove surface imperfections.

(2) Forging

In general forged aluminum alloys of the present invention will benefit from forging temperatures being as low as possible consistent with the alloy composition and equipment. Forging may be carried out as a single or multi-step operation. In multi-step forging the temperature control applies to the initial forging or blocking-type step. As in the extrusion step, it is believed that for high strength the aluminum alloys of this invention should be forged at a temperature below one where a decrease in strength will occur. In the Al-Mg-Li alloys system forging should be carried out below about 400° C. (750° F.), and preferably less than 370° C.) (700° F.), e.g. in the range of 230° C. (450° F.) to about 345° C. (650° F.), typically about 260° C. (500° F.). Despite the fact that forgeability may increase with temperature, the higher forging temperatures have now been found to have an adverse effect on strength. In a multi-step forging operation it has been found that it is the initial step that is critical. In subsequent forging steps of a multi-step operation after the initial forging step the temperature range for forging may be above that recommended for this process.

As noted above, while it is known in the art that conditions of forging aluminum alloys will vary with composition, it was surprising that the forging conditions—particularly the temperature—at which the alloys could be forged is related to the temperature at which the alloy is consolidated, and in particular extruded.

(3) Age Hardening

A heat treatment may be carried out, if desired, on alloy systems susceptible to age hardening. In alloys having age hardenable components additional strength may be gained, but this may be with the loss of other properties, e.g. corrosion resistance. It is a particular advantage of the present invention that low density aluminum alloys can be made with high strength, e.g. over 410 MPa (60 ksi) in the forged condition without having to resort to precipitation hardening treatments which might result in alloys which have less attractive properties other than strength.

It is noted that in conversion from °F. to 20 C., the temperatures were rounded off, as were the conversion from ksi to MPa and inches to centimeters. Also alloy compositions are nominal. With respect to conditions, for commercial production it is not practical or realistic to impose or require conditions to the extent possible in a research laboratory facility. Temperatures may stray, for example, 50° F. of the target. Thus, having a wider window for processing conditions adds to the practical value of the process.

This invention is further described in, but not limited by, the examples given below. In all the examples the test samples were prepared from dispersion strengthened alloys comprising aluminum, magnesium, lithium, carbon and oxygen, prepared by a mechanical alloying technique.

EXAMPLE 1

This example illustrates the processing conditions used to prepare forged Al-Mg-Li dispersion strengthened mechanically alloyed composed of aluminum, magnesium, lithium, carbon and oxygen containing about 1.1–1.2% carbon and less than 1% oxygen.

Mechanically alloyed Al-Li-Mg powders are prepared having the nominal magnesium and lithium contents given in TABLE I. The powders are vacuum hot pressed (VHP) to form 27.9 cm (11 in) diameter degassed compaction billets.

The compaction billets are then extruded at temperatures of about 260° and 370° C. (500° and 700° F.) at ram speeds of 45.7 and 25.4 cm (18 and 10 in.), depending on the extrusion temperature. All billets are sandblasted and coated with Fel-Pro C-300 (a molybdenum disulfide air drying product of Fel-Pro Inc.) prior to heat-up for extrusion, and the extrusion liner coated with resin and swathed with the lubricant LUBE-A-TUBE hot extrusion 230A (a graphite in heavy oil product of G. Whitfield Richards Co.). All the extrusions pushed successfully except for some surface tearing at 700° F. Alloy compositions and extrusion conditions, are given in TABLE I.

TABLE I

| Alloy | | | Temp. | | Ram Speed | |
|---|---|---|---|---|---|---|
| Type | Mg | Li | °C. | (°F.) | cm | (in.)/min |
| A | 4 | 1.5 | 260 | (500) | 45.7 | (18) |
| B | 4 | 1.75 | 260 | (500) | 45.7 | (18) |
| C | 2 | 2 | 260 | (500) | 45.7 | (18) |
| D | 4 | 1.5 | 370 | (700) | 25.4 | (10) |
| E | 4 | 1.75 | 370 | (700) | 25.4 | (10) |
| F | 2 | 2 | 370 | (700) | 25.4 | (10) |

Eight 8.75 cm (3.5 in.) lengths of material from each extrusion are cut for forging trials. The trial consisted of using flat dies to upset the performs parallel to the billet axis. Forgings are performed at nominal temperatures 260° C. (500° F.) and 400° C. (750° F.) at ram speeds of 50 cm (20 in.)/min and 5 cm (2 in.)/min to final heights of 5 cm (1 in.) and 2.5 cm (0.5 in.) and strains of −0.67 and −0.83, respectively. The top and bottom forging platens are induction heated to the same temperatures as the soak temperatures and were lubricated with White and Bagley 2965 graphite base lubricant just before upsetting. Extrusion and forging data are summarized in TABLE II. In general the 260° C. (500° F.) extrusions forged better than the 370° C. (700° F.) extrusions, and this is believed to be due to the better extruded surface quality of the 500° F. extrusions. Surface grinding prior to forging should improve forgeability. The 2Mg-2Li alloy extruded at 370° C. (700° F.) had the poorest forgeability. For all of the other alloys a forging condition can be found that does not cause edge cracking. In general, the alloys extruded at 260° C. (500° F.) have a higher hardness than material extruded at 370° C. (700° F.). The 4Mg-1.5Li composition extruded at 260° C. (500° F.) did not soften under any of the forging conditions tried. The 2Mg-2Li alloys soften after forging at about 400° C. (750° F.).

TABLE II

| Alloy ID | Extrusion Soak T °F. | Extrusion Ram Sp in/min | Forging Soak T °F. | Forging Billet T °F. | Forging Die T °F. | Forging Ram Sp in/min | Forging Final Height in. | Forging Forging Appear.* | Hardness $R_B$ |
|---|---|---|---|---|---|---|---|---|---|
| 4Mg—1.5Li | 500 | 10 | As Ext | | | | | | 84 |
| 1 | | | 500 | — | 500 | 20 | 0.95 | 3 | 87 |
| 2 | | | 500 | — | 500 | 20 | 0.53 | 2 | 87 |
| 3 | | | 500 | 425 | 500 | 2 | 0.980 | 2 | 86 |
| 4 | | | 500 | 430 | 501 | 2 | 0.540 | 2 | 86 |
| 5 | | | 750 | 680 | 737 | 20 | 1.0 | 2 | 85 |
| 6 | | | 750 | — | 734 | 20 | 0.520 | 3 | 84 |
| 7 | | | 750 | 690 | 735 | 2 | 0.960 | 3 | 83 |
| 8 | | | 750 | 690 | 747 | 2 | 0.525 | 3 | 82 |
| 4Mg—1.75Li | 500 | 18 | As Ext | | | | | | 86 |
| 1 | | | 500 | 440 | 497 | 20 | 0.8 | 1 | 88 |
| 2 | | | 500 | 440 | 496 | 20 | 0.52 | 1 | 87 |
| 3 | | | 500 | — | 497 | 2 | 1.0 | 2 | 85 |
| 4 | | | 500 | — | 495 | 2 | 0.53 | 3 | 86 |
| 5 | | | 750 | 680 | 752 | 20 | 0.965 | 3 | 85 |
| 6 | | | 750 | 680 | 760 | 20 | 0.540 | 2 | 86 |
| 7 | | | 750 | 680 | 760 | 2 | 0.940 | 2 | 84 |
| 8 | | | 750 | 670 | 760 | 2 | 0.510 | 3 | 84 |
| 2Mg—2Li | 500 | 18 | As Ext | | | | | | 85 |
| 1 | | | 500 | 440 | 494 | 20 | 0.965 | 3 | 84 |
| 2 | | | 500 | — | 493 | 20 | 0.580 | 2 | 85 |
| 3 | | | 500 | 440 | 496 | 2 | 1.0 | 3 | 82 |
| 4 | | | 500 | — | 495 | 2 | 0.560 | 2 | 85 |
| 5 | | | 750 | 680 | 759 | 20 | 0.935 | 3 | 80 |
| 6 | | | 750 | — | 759 | 20 | 0.510 | 3 | 81 |
| 7 | | | 750 | 680 | 752 | 2 | 0.960 | 3 | 80 |
| 8 | | | 750 | 690 | 755 | 2 | 0.50 | 1 | 80 |
| 4Mg—1.5Li | 700 | 10 | As Ext | | | | | | 83 |
| 1 | | | 500 | 480 | 495 | 20 | 0.980 | 2 | 85 |
| 2 | | | 500 | 460 | 515 | 20 | 0.530 | 2 | 86 |
| 3 | | | 500 | 450 | 575 | 2 | 1.0 | 2 | 85 |
| 4 | | | 500 | 450 | 512 | 2 | 0.565 | 2 | 87 |
| 5 | | | 750 | — | 754 | 20 | 0.980 | 3 | 83 |
| 6 | | | 750 | 680 | 754 | 20 | 0.530 | 2 | 82 |
| 7 | | | 750 | — | 754 | 2 | 1.03 | 2 | 82 |
| 8 | | | 750 | 670 | 754 | 2 | 0.5 | 2 | 82 |
| 4Mg—1.75Li | 700 | 10 | As Ext | | | | | | 80 |
| 1 | | | 500 | — | 514 | 20 | 1.01 | 3 | 83 |
| 2 | | | 500 | 460 | 513 | 20 | 0.565 | 1 | 84 |
| 3 | | | 500 | 450 | 514 | 2 | 1.025 | 3 | 84 |
| 4 | | | 500 | 440 | 512 | 2 | 0.515 | 1 | 85 |
| 5 | | | 750 | 700 | 749 | 20 | 0.99 | 3 | 82 |
| 6 | | | 750 | — | 742 | 20 | 0.535 | 2 | 83 |
| 7 | | | 750 | 700 | 745 | 2 | 0.98 | 3 | 82 |
| 8 | | | 750 | 700 | 742 | 2 | 0.55 | 1 | 81 |
| 2Mg—2Li | 700 | 10 | As Ext | | | | | | 80 |
| 1 | | | 500 | — | 506 | 20 | 0.975 | 2 | 80 |
| 2 | | | 500 | 440 | 503 | 20 | 0.575 | 1 | 82 |
| 3 | | | 500 | 440 | 506 | 2 | 1.025 | 2 | 79 |
| 4 | | | 500 | — | 504 | 2 | 0.6 | 2 | 80 |
| 5 | | | 750 | 690 | 742 | 20 | 1.01 | 2 | 77 |
| 6 | | | 750 | 680 | 746 | 20 | 0.42 | 2 | 79 |
| 7 | | | 750 | 690 | 749 | 2 | 0.93 | 2 | 77 |
| 8 | | | 750 | — | 745 | 2 | 0.45 | 1 | 77 |

In the TABLE:
500° F. = 260° C.:
700° F. = 370° C.:
1 inch = 2.5 cm
*1 = poor
2 = good
3 = excellent

EXAMPLE 2

This example concerns the aging response of extruded and forged alloys described in EXAMPLE 1.

To streamline the aging study two forgings from each alloy of EXAMPLE 1 are selected. One of each type is forged at 260° C. (500° F.) at 50.8 cm (20 in)/min to 2.54 cm (1 in.) final height, and the other is forged at 400° C. (750° F.) at 5.08 cm (2 in)/min to 1.27 cm (0.5 in) final height. These are the two extreme forging conditions. The compositions 4Mg-1.75Li and 2Mg-2Li show hardness increases at about 125° C. (255° F.) after solution treating at about 480° C. (900° F.), and from the hardness data it can be predicted that both these alloys can be aged to achieve the desired target YS in the forged condition of about 410 to 450 MPa (60–65 ksi). The "as-extruded" alloys appear to age slower than the forged stock. It is assumed that the additional working of forging speeds the aging kinetics.

EXAMPLE 3

This example illustrates forgeability of alloys in a cruciform forging test. Cruciform forging trials are performed on extruded billets of the type shown in Example 1, all alloys being extruded with lubrication through a 3.875 in. dia. conical die in an 8:1 extrusion ratio.

The "cruciform"-type forging is shown in plan view in FIG. 1. The center portion of the forging is a cruciform formed from two perpendicular raised ribs. The rib portion of the forging is thicker than the base portion. The forging in the tests is made in a two-step operation: (1) blocking extrusion perform on flat dies; (2) forging blocker into raised rib "cruciform", the blocking extrusion corresponding to an initial forging step in a forging operation. The 5 in.×3.675 in. dia. extruded preforms are blocked in the extrusion direction to 2.5 in. high. The blockers are "squared-up" by repeatedly pressing perpendicular to the extrusion direction forming an octahedron approximately 2.5 in. high with a 5.25 in. diagonal. The flat dies are held at about 315° C. (600° F.±25° F.) and no lubricant is used. Extruded surface roughness produced cracking during the blocker operations. Preforms with gross surface surface defects had been ground prior to blocking and had less tendency to crack than did as-extruded surfaces. Blocker cracking also occurred due to high forging speeds, necessitating blocking speed to be lowered from 50.8–63.5 cm (20–25 in)/min to 12.7 cm (5 in)/min.

All cruciforms are final forged at 370° C. (700° F.), at a constant die temperature of 315° C. (600° F.), press rate of 12.7 cm (5 in)/min, utilizing full press tonnage of 1500 tons. The die was lubricated with a 1 to 3 mixture of Withrow-A-Paste (a lubricant of a graphite type product of Arthur C. Withrow Co.) and mineral oil. Cruciforms of acceptable appearance were forged of each material. Most problems in blocker cracking appear to be due to surface imperfections. Some cracking in the cruciform was related to slight cracking in the blocker. Recorded in TABLE III are extrusion temperature, blocker temperature, forging temperature and "as-forged" hardness for various aluminum alloys of this invention.

TABLE III

| Alloy Type | Ext. Temp. °F. | Block Temp. °F. | Forged Temp. °F. | As-Forged Hardness, $^{R}B$ |
|---|---|---|---|---|
| 4Mg—1.5Li | 500 | 500 | 700 | 79 |
| | 500 | 700 | 700 | 79 |
| 4Mg—1.5Li | 700 | 500 | 700 | 80 |
| | 700 | 700 | 700 | 77 |
| 4Mg—1.75Li | 500 | 500 | 700 | 80 |
| | 500 | 700 | 700 | 81 |
| 2Mg—2Li | 500 | 500 | 700 | 80 |
| | 500 | 700 | 700 | 78 |
| 4Mg—1.75Li | 700 | 500 | 700 | 79 |
| | 700 | 700 | 700 | 80 |
| 2Mg—2Li | 700 | 700 | 700 | 71 |

All of the 4Mg-1.5Li alloys have "as-forged" hardnesses greater than 78 $R_B$ except for the alloy extruded, blocked and forged at 370° C. (700° F.) and it was ascertained that in these forgings a hardness of 78 $R_B$ or better correlates to a YS of 410 MPa (60 ksi) or better. Accordingly, the inference can be made that alloys extruded at 370° C. (700° F.) and blocked at 260° C. (500° F.) would meet the target forged YS requirement of 410 MPa (60 ksi).

The "as-forged" hardness of compositions 4Mg-1.75Li and 2Mg-2Li can be improved by aging treatments. The 2Mg-2Li ages slower than the 4Mg-1.75Li alloy.

EXAMPLE 4

This example illustrates the tensile properties of various Al-Mg-Li alloys of this invention in the extruded, blocked, forged and/or aged conditions of cruciform-type forgings tested at two different sites.

Tensile properties of various Al-Mg-Li alloys, essentially of the type described in EXAMPLE 1, in the extruded, blocked, forged and/or aged conditions are given in TABLE IV. The blocked and forged conditions, viz. "Block Temp" and "Forge Temp", respectively, refer to the temperatures of the two steps given in EXAMPLE 3 for forming the cruciform-type forging. All tests are carried out in the rib portion of the cruciform. The key to the temper of the tensile sample (TPR) is: 1=as-extruded, 2=as-blocked, 3="as-forged", 4=forged and solution treated at 480° C. (900° F.) for 2 hours and water quenched (WQ) then aged at 125° C. (255° F.) for 2 hours, and 5=solution treated as in TPR 4 but aged at 150° C. (300° F.) for 24 hours; Mod=Young's Modulus. Tensile properties obtained on different test equipment for a duplicate set of forged cruciform forgings on either the base (B) or rib (R) portion in various tempers and orientations are given in TABLE IV.

Reference to TABLE IV shows:

The non-heat treatable Al-4Mg-1.5Li alloy extruded at 260° C. (500° F.), blocked at 260° C. (500° F.) and forged at 370° C. (700° F.), has a 444 MPa (64.4 ksi) YS, 518 MPa (75.2 ksi) UTS (ultimate tensile strength) and 11% El (elongation to failure). The "as-extruded", YS 477 MPa (69.3 ksi), is higher than the forged material, while the "as-extruded" ductility, 7% El, is lower. The strengths of the 260° C. (500° F.) blocker are less than the forged strengths. The 4Mg-1.5Li alloy extruded at 370° C. (700° F.) and blocked at 260° C. (500° F.), has a YS=424 MPa (61.5 ksi).

For all conditions tested the 4Mg-1.75Li alloy extruded at 260° C. (500° F.) has a YS of greater than 410 MPa (60 ksi). Solution treating and aging raises the YS to approximately 572 MPa (83 ksi) with just a slight decrease in ductility from the "as-forged" condition. The 370° C. (700° F.) extrusion blocked at 260° C. (500° F.) can also be aged (TPR=4) to 551 MPa (80 ksi) yield strength. For the same aging treatment the 370° C. (700° F.) extrusion blocked at 370° C. (700° F.) has a 537 MPa (78 ksi) YS.

The 2Mg-2Li alloy extruded at either 260° C. (500° F.) or 370° C. (700° F.) produce forgings that have lower as-forge strength than the alloys containing 4% magnesium. Aging at (TPR=5) increases the YS to 530 MPa (77 ksi) and 502 MPa (73 ksi), respectively, for the 260° C. (500° F.) and 370° C. (700° F.) extrusions blocked at 370° C. (700° F.).

The tests demonstrate the importance of extrusion temperature in processing mechanically alloyed Al-Mg-Li alloys to maximize strength in the final forging. Blocker temperature has a secondary effect on forged strength with the lower blocker temperature leading to high strengths. Final forging temperature appears to be of less importance as long as the material has been extruded and blocked at relatively low temperatures.

A comparison of data for "as-forged" longitudinal samples in TABLES IV and V shows the consistency of results in different testing equipment.

TABLE IV

| Ext. Temp. °F. | Blocker Temp. °F. | Forge Temp. °F. | TPR | Orient. | Tensile Properties YS ksi | UTS ksi | % El. | % RA | Mod $10^6$ psi |
|---|---|---|---|---|---|---|---|---|---|
| | | | | Al—4Mg—1.5Li | | | | | |
| 500 | — | — | 1 | L | 69.3 | 74.8 | 7 | 12.5 | 10.9 |
| 500 | — | — | 1 | T | 67.9 | 78.7 | 0 | 1 | 14.0 |
| 500 | 500 | — | 2 | L | 61.7 | 73.7 | 3.5 | 8.5 | 11.2 |
| 500 | 500 | 700 | 3 | L | 64.4 | 75.2 | 11 | 22 | 10.9 |
| 500 | 700 | — | 2 | L | 59.9 | 72.2 | 7.5 | 12 | 10.8 |
| 500 | 700 | 700 | 3 | L | 58.8 | 71.8 | — | 19 | 11.1 |
| | | | | Al—4Mg—1.5Li | | | | | |
| 700 | — | — | 1 | L | 65.9 | 73.1 | 6 | 11 | 11.5 |
| 700 | — | — | 1 | T | 61.9 | 73.2 | 2 | 4.5 | 11.2 |
| 700 | 500 | — | 2 | L | 57.7 | 75.3 | 3.5 | 9.5 | 10.2 |
| 700 | 500 | 700 | 3 | L | 61.5 | 74.6 | — | 9.5 | 10.0 |
| 700 | 700 | — | 2 | L | 55.1 | 71.4 | 7.5 | 12.5 | 10.9 |
| 700 | 700 | 700 | 3 | L | 55.6 | 70.7 | — | 17.0 | 10.5 |
| | | | | Al—4Mg—1.75Li | | | | | |
| 500 | — | — | 1 | L | 75.9 | 96 | 0.5 | 1.0 | 11.4 |
| 500 | — | — | 1 | T | 65.9 | 79.3 | 0 | 0.5 | 11.2 |
| 500 | 500 | — | 2 | L | 62.5 | 80.2 | 0 | 1.5 | 10.7 |
| 500 | 500 | 700 | 3 | L | 63.5 | 74.4 | — | 9.0 | 11.1 |
| 500 | 500 | 700 | 4 | L | 82.7 | 87.4 | — | 8.25 | 10.5 |
| 500 | 700 | — | 2 | L | 58.2 | 73.8 | 2.0 | 7.0 | 10.0 |
| 500 | 700 | 700 | 3 | L | 61.7 | 75.5 | 4.5 | 4.0 | 11.6 |
| 500 | 700 | 700 | 4 | L | 82.6 | 88.1 | 3.5 | 11 | 10.5 |
| | | | | Al—2Mg—2Li | | | | | |
| 500 | — | — | 1 | L | 73.5 | 91.1 | 0.5 | 2.5 | 11.6 |
| 500 | — | — | 1 | T | 60.1 | 71.1 | 0 | 1.0 | 11.7 |
| 500 | 500 | — | 2 | L | 53.8 | 67.5 | 0 | 1.5 | 10.4 |
| 500 | 500 | 700 | 3 | L | 56.6 | 69.5 | 4.5 | 11.0 | 9.8 |
| 500 | 500 | 700 | 5 | L | — | — | — | — | — |
| 500 | 700 | — | 1 | L | 53.8 | 67.5 | 0 | 1.5 | 10.4 |
| 500 | 700 | 700 | 3 | L | 56.6 | 69.5 | 4.5 | 11.0 | 9.8 |
| 500 | 700 | 700 | 5 | L | 77.3 | 84.5 | 2 | 4.3 | 10.6 |
| | | | | Al—4Mg—1.75Li | | | | | |
| 700 | — | — | 1 | L | 63.8 | 70.2 | 2.0 | 4.0 | 11.1 |
| 700 | — | — | 1 | T | 61.9 | 72.9 | 1.0 | 0.5 | 11.3 |
| 700 | 500 | — | 2 | L | 55.9 | 72.4 | 2.0 | 9.5 | 10.4 |
| 700 | 500 | 700 | 3 | L | 58.3 | 72.3 | 6.5 | 11.0 | 10.7 |
| 700 | 500 | 700 | 4 | L | 80 | 85.7 | 3.5 | 10 | 10.4 |
| 700 | 700 | 700 | 3 | L | 53.1 | 73 | 6.5 | 10.5 | 10.8 |
| 700 | 700 | 700 | 3 | L | 56.1 | 71.3 | 6.5 | 10.0 | 11.2 |
| 700 | 700 | 700 | 4 | L | 78 | 85 | 3.5 | 9 | 10.3 |
| 700 | 700 | 700 | 4 | L | 75.5 | 84.3 | 7.0 | 10.1 | 11.2 |
| | | | | Al—2Mg—2Li | | | | | |
| 700 | — | — | 1 | L | 65.7 | 76.4 | 1 | 4.5 | 11.6 |
| 700 | — | — | 1 | T | 56.6 | 68.5 | 1 | 0.5 | 11.3 |
| 700 | 500 | — | 2 | L | 48.3 | 64.2 | 2 | 7.0 | 9.2 |
| 700 | 500 | 700 | 3 | — | — | — | — | — | — |
| 700 | 500 | 700 | 3 | — | — | — | — | — | — |
| 700 | 700 | — | 2 | L | 48.7 | 64.3 | 2 | 4.5 | 9.2 |
| 700 | 700 | 700 | 3 | L | 48.2 | 63.6 | 9 | 15 | 11.3 |
| 700 | 700 | 700 | 5 | L | 73 | 80.1 | 3.5 | 4.0 | 11.1 |

TABLE V

| Alloy (Extrusion & Blocker Conditions) | Test Orient. | Temper* | YS ksi | UTS ksi | % El |
|---|---|---|---|---|---|
| Al—4Mg—1.5Li | T R | F | 64.7 | 75.2 | 6.7 |
| (500° F. Extrusion) | T R | ST + A | 65.7 | 75.2 | 8.1 |
| (500° F. Blocker) | T B | ST + A | 66.8 | 76.0 | 9.5 |
| | T B | ST | 65.0 | 76.8 | 8.1 |
| | L R | ST + A | 69.2 | 77.6 | 12.3 |
| | L R | ST + A | 68.8 | 78 | 10.9 |
| | L R | F | 69.2 | 78.1 | 8.1 |
| | L R | F | 70.4 | 77.7 | 8.1 |
| | T B | ST + A | 64.8 | 74.0 | 10.2 |
| Al—4Mg—1.5Li | T R | F | 60.8 | 72.8 | 9.5 |
| (500° F. Extrusion) | T R | ST + A | 64.8 | 74.0 | 9.5 |
| (700° F. Blocker) | T B | ST + A | 61.2 | 72.8 | 12.3 |
| | T B | ST | 62.8 | 73.2 | 12.3 |
| | L R | ST + A | 62.4 | 72.8 | 15.1 |
| | L R | ST + A | 60.4 | 72.8 | 12.3 |
| | L R | F | 60.0 | 72.4 | 10.9 |
| | L R | F | 60.0 | 71.6 | 10.9 |
| | T B | ST + A | 60.8 | 72.4 | 10.2 |

TABLE V-continued

| Alloy (Extrusion & Blocker Conditions) | Test Orient. | Temper* | YS ksi | UTS ksi | % El |
|---|---|---|---|---|---|
| Al—4Mg—1.5Li | T R | F | 60.4 | 74.9 | 8.1 |
| (700° F. Extrusion) | T R | ST + A | 61.2 | 74.4 | 6.7 |
| (500° F. Blocker) | T B | ST + A | 61.2 | 74.4 | 8.1 |
| | T B | ST | 60.4 | 73.6 | 8.1 |
| | L R | ST + A | 63.2 | 74.8 | 10.9 |
| | L R | ST + A | 63.3 | 75.2 | 12.3 |
| | L R | F | 63.6 | 75.2 | 6.7 |
| | L R | F | 63.2 | 74.8 | 8.1 |
| | T B | ST + A | 60.8 | 73.2 | 6.7 |
| Al—4Mg—1.5Li | T R | F | 58.8 | 72.8 | 9.5 |
| (700° F. Extrusion) | T R | ST + A | 62.8 | 75.2 | 12.3 |
| (700° F. Blocker) | T B | ST + A | 61.2 | 74.0 | 9.5 |
| | T B | ST | 60.8 | 73.2 | 8.1 |
| | L R | ST + A | 62.0 | 74.8 | 11.6 |
| | L R | ST + A | 60.0 | 73.6 | 9.5 |
| | L R | F | 59.2 | 73.2 | 8.1 |
| | L R | F | 58.8 | 73.6 | 10.9 |
| | T B | ST + A | 60.0 | 73.5 | 12.3 |

TABLE V-continued

| Alloy (Extrusion & Blocker Conditions) | Test Orient. | Temper* | YS ksi | UTS ksi | % El |
|---|---|---|---|---|---|
| Al—4Mg—1.75Li | T R | F | 61.6 | 75.2 | 6.7 |
| (500° F. Extrusion) | T R | ST + A | 86.8 | 90.8 | 5.3 |
| (500° F. Blocker) | T B | ST + A | 88.8 | 92.0 | 6.7 |
| | T B | ST | 69.4 | 77.9 | 6.7 |
| | L R | ST + A | 90.5 | 93.7 | 6.7 |
| | L R | ST + A | 90.8 | 94.0 | 5.3 |
| | L R | F | 67.2 | 75.6 | 3.9 |
| | L R | F | 68.4 | 79.2 | 3.9 |
| | T B | ST + A | 86.8 | 89.2 | 5.3 |
| Al—4Mg—1.75Li | T R | F | 65.2 | 75.6 | 5.3 |
| (500° F. Extrusion) | T R | ST + A | 88.4 | 93.2 | 3.9 |
| (700° F. Blocker) | T B | ST + A | 86.8 | 91.6 | 3.9 |
| | T B | ST | 65.6 | 76.0 | 8.1 |
| | L R | ST + A | 89.2 | 92.8 | 6.7 |
| | L R | ST + A | 88.1 | 91.4 | 5.3 |
| | L R | F | 63.2 | 76.4 | 6.7 |
| | L R | F | 63.2 | 69.2 | 3.2 |
| | T B | ST + A | 85.4 | 88.7 | 2.5 |
| Al—4Mg—1.75Li | T R | F | 60.0 | 72.8 | 8.1 |
| (700° F. Extrusion) | T R | ST + A | 83.6 | 88.4 | 3.9 |
| (500° F. Blocker) | T B | ST + A | 85.2 | 89.7 | 5.3 |
| | T B | ST | 63.6 | 76.0 | 10.9 |
| | L R | ST + A | 85.2 | 89.2 | 5.3 |
| | L R | ST + A | 85.2 | 89.2 | 3.9 |
| | L R | F | 61.6 | 72.8 | 8.1 |
| Al—4Mg—1.75Li | T R | F | 60.4 | 72.8 | 3.9 |
| (700° F. Extrusion) | T R | ST + A | 83.2 | 89.2 | 6.7 |
| (700° F. Blocker) | T B | ST + A | 81.9 | 86.7 | 3.9 |
| | T B | ST | 61.2 | 74.0 | 10.9 |
| | L R | ST + A | 83.2 | 88.0 | 6.0 |
| | L R | ST + A | 82.8 | 86.8 | 6.7 |
| | L R | F | 58.8 | 74.0 | 9.5 |
| | L R | F | 58.8 | 74.4 | 9.5 |
| | T B | ST + A | 84.0 | 87.2 | 3.9 |
| Al—2Mg—2Li | T R | F | 59.6 | 74.0 | 5.3 |
| (500° F. Extrusion) | T R | ST + A | 81.6 | 88.8 | 3.9 |
| (500° F Blocker) | T B | ST + A | — | 76.6 | — |
| | T B | ST | 58.1 | 68.2 | 2.5 |
| | L R | ST + A | 84.4 | 90.8 | 3.9 |
| | L R | ST + A | 82.0 | 89.2 | 2.5 |
| | L R | F | 60.0 | 72.8 | 3.2 |
| | L R | F | 58.0 | 72.8 | 2.5 |
| | T B | ST + A | 82.8 | 88.8 | 2.5 |
| Al—2Mg—2Li | T R | F | 58.0 | 70.8 | 3.9 |
| (500° F. Extrusion) | T R | ST + A | 80.5 | 86.5 | 1.8 |
| (700° F. Blocker) | T B | ST + A | — | 81.2 | — |
| | T B | ST | 58.0 | 69.6 | 3.9 |
| | L R | ST + A | 82.4 | 87.2 | 6.7 |
| | L R | ST + A | 80.0 | 86.4 | 2.5 |
| | L R | F | 54.0 | 67.2 | 3.8 |
| | L R | F | 53.6 | 68.8 | 2.5 |
| | T B | ST + A | 80.0 | 84.0 | 2.5 |
| Al—2Mg—2Li | T R | F | 50.4 | 65.2 | 8.1 |
| (700° F. Extrusion) | T R | ST + A | 75.2 | 80.4 | 6.7 |
| (700° F. Blocker) | T B | ST + A | 74.4 | 81.2 | 5.3 |
| | T B | ST | 51.6 | 65.0 | 8.1 |
| | L R | ST + A | 76.4 | 81.2 | 3.2 |
| | L R | ST + A | 73.2 | 79.2 | 5.3 |
| | L R | F | 50.0 | 64.8 | 10.9 |
| | L R | F | 49.6 | 64.0 | 6.7 |
| | T B | ST + A | 74.8 | 79.2 | 3.9 |

*Tempers:
F = As-Forged - 370° C. (700° F.)
ST = Solution Treated - 495° C. (925° F.)/1 hr/WQ
A = Aged - 125° C. (255° F)/10 hr/AC

EXAMPLE 5

This example illustrates the tensile properties of the dispersion strengthened alloys of this invention in "Hook"-type forging samples. All materials were prepared as extruded billets essentially as shown in EXAMPLE 1

The "Hook" forging die set used in the tests consists of a high deformation 1st blocker die, a 2nd blocker die which raises the ribs of the forging and a finish die which produces minimal deformation but achieves final tolerances in the part. For this test to avoid the time and expense of using the finish die, evaluation of the forgings was made after the 2nd blocker, i.e. at an intermediate forging step.

Figure 2:
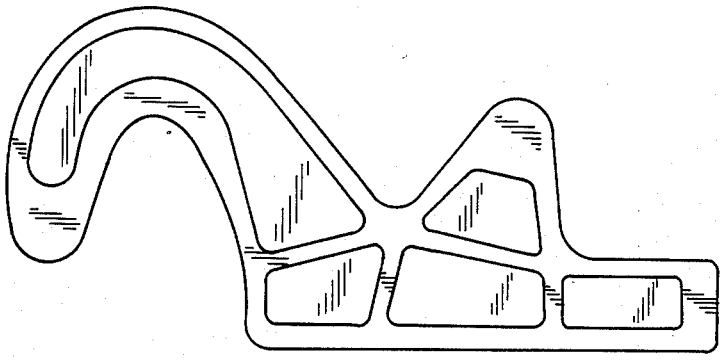
FIG. 2 is a plan drawing of a "Hook"-type forging.

FIG. 2 shows a plan drawing of the finished "Hook"-type forging. Tensile specimens were heat treated in sets of two, representing the longitudinal (L) and the short transverse (ST) orientations.

TABLE VI shows properties in two directions for forgings in two conditions: F (as-forged) and T4 (solution treated and naturally aged) for an alloy system containing 4Mg-1.5Li. The data show no significant difference in results between the F and T4 conditions. The best properties exhibited in TABLE VI are for the alloy of test 1, i.e. in the as-forged condition processed at 260° C. (500° F.) extrusion and first blocker temperatures. The data confirm that strength is primarily controlled by extrusion temperature and secondarily by blocker temperature.

TABLE VI

| Ext. Temp. (°F.) | 1st Blocker Temp. (°F.) | 2nd Blocker Temp. (°F.) | Orient. | Temper | YS (ksi) | UTS (ksi) | El % | RA % |
|---|---|---|---|---|---|---|---|---|
| 500 | 500 | 610 | L | F | 67.0 | 76.2 | 13 | 25 |
| 500 | 500 | 610 | ST | F | 62.4 | 71.7 | 11 | 15 |
| 500 | 500 | 610 | L | T4 | 66.4 | 76.0 | 14 | 23 |
| 500 | 500 | 610 | ST | T4 | 62.0 | 71.7 | 7 | 11 |
| 500 | 675 | 610 | L | F | 65.6 | 74.0 | 14 | 26 |
| 500 | 675 | 610 | ST | F | 58.8 | 71.1 | 10 | 20 |
| 500 | 675 | 610 | L | T4 | 64.2 | 74.2 | 13 | 23 |
| 500 | 675 | 610 | ST | T4 | 60.2 | 71.7 | 11 | 21 |
| 700 | 500 | 610 | L | F | 59.6 | 72.8 | 12 | 18 |
| 700 | 500 | 610 | ST | F | 59.0 | 71.8 | 9 | 12 |
| 700 | 500 | 610 | L | T4 | 59.4 | 72.6 | 13 | 20 |
| 700 | 500 | 610 | ST | T4 | 59.8 | 71.5 | 7 | 14 |
| 700 | 675 | 610 | L | F | 59.8 | 70.0 | 14 | 23 |
| 700 | 675 | 610 | ST | F | 54.4 | 68.3 | 11 | 18 |
| 700 | 675 | 610 | L | T4 | 56.4 | 70.2 | 14 | 22 |
| 700 | 675 | 610 | ST | T4 | 53.4 | 67.1 | 12 | 21 |

Similar tests carried out on alloys containing 4Mg-1.75Li and 2Mg-2Li in blocked forgings showed that the Li level affected both the strength and age hardening aspects of the alloys markedly.

A comparison with results on "cruciform" forgings shows that there is essentially the same trend in the alloy properties resulting from the processing conditions.

EXAMPLE 6

This example illustrates the effect of normal forging practice on the tensile properties of a forged sample of an alloy of the type Al-4Mg-1.5Li. An extruded billet is prepared from a vacuum hot pressed compaction billet as described in EXAMPLE 1. The compaction billet was extruded from 27.9 cm (11 in) to 9.53 cm (3¾ in) diameter rod at temperatures of 650°–700° F. through a shear-faced die at an extrusion ram speed of 0.1 in/sec. and a breakthrough pressure of 1100–1600 tons. The extrusion liner was lubricated but not the billets. A "Hook" forging was made at a temperature of 420° C. (788° F.) in the first blocker and 488° C. (838° F.) in the second blocker. Tensile tests on various locations on the specimen showed it to have in the as-forged condition the average properties: YS of 368 MPA (52.7 ksi), UTS of 470 MPa (68.3 ksi), El of 14.5% and RA of 19.7%. In the solution treated condition of 1 hour at 480° C. (900° F.)/glycol quench condition the average properties are:

YS of 352 MPa (51.5 ksi), UTS of 466 MPa (67.6 ksi), El of 14% and the RA of 19.9%. The method of this example is not effective for achieving the maximum strength potential of the alloy.

EXAMPLE 7

This example illustrates the effect of normal forging practice on the tensile properties of a cruciform forging. An extruded billet of an alloy of the 4Mg-1.5Li-type is prepared as described in EXAMPLE 6. The first blocker temperature of the cruciform forging is carried out at 370° C. (700° F.). A lubricant, a Withrow A Paste-mineral oil mixture, is used in the finish forging which is carried out at various temperatures. Finish forging temperatures and tensile properties of the finish cruciform forgings in the longitudinal and transverse directions are shown in TABLE VII. The method of this example is not effective for achieving maximum strength potential of the alloy.

TABLE VII

| Direction | Forging Temp. (°F.) | YS | UTS | El (%) | RA (%) |
|---|---|---|---|---|---|
| Longitudinal | 600 | 52.6 | 68.2 | 12 | 15 |
| | 600 | 51.1 | 66.2 | 12 | 20 |
| | 650 | 52.4 | 67.8 | 11 | 16 |
| | 650 | 51.7 | 67.4 | 11 | 18 |
| | 700 | 52.3 | 66.7 | 12 | 17 |
| | 700 | 52.0 | 65.9 | 11 | 19 |
| | 750 | 51.8 | 66.4 | 11 | 16 |
| | 750 | 51.6 | 66.6 | 13 | 16 |
| | 800 | 51.3 | 66.4 | 13 | 17 |
| | 800 | 50.9 | 66.2 | 11 | 16 |
| Short Transverse | 600 | 49.9 | 62.7 | 5 | 6 |
| | 600 | 51.3 | 65.3 | 5 | 3 |
| | 600 | 50.3 | 57.7 | 2 | 5 |
| | 600 | 53.1 | 62.6 | 2 | 7 |
| | 700 | 49.9 | 65.1 | 11 | 13 |
| | 750 | 49.9 | 63.9 | 6 | 10 |
| | 800 | 49.8 | 65.8 | 11 | 11 |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A method for obtaining a forged product composed of a dispersion strengthened, low density aluminum-base alloy comprised of aluminum, lithium and magnesium, said alloy being derived from a powder of said alloy prepared by a mechanical alloying process, said method being comprised of a sequence of steps comprising: degassing and compacting said powder under vacuum to obtain a compaction billet having a density sufficiently high to obtain an extruded billet of substantially full density; extruding the resultant compaction billet at a temperature in the range of above the incipient extrusion temperature up to about 400° C. (750° F.) said extrusion being carried out with lubrication through a conical die to provide an extruded billet of substantially full density; and forging the resultant extruded billet, said resultant billet being subjected to at least a first forging treatment at a temperature in the range of about 230° C. (450° F.) up to about 400° C. (750° F.), with the proviso that for maximizing strength the forging is carried out at the lower end of the forging temperature range when the extrusion is carried out at the higher end of the extrusion temperature range.

2. A method according to claim 1, wherein the degassing and compacting steps are carried out by vacuum hot pressing the powder.

3. A method according to claim 1, wherein degassing and compacting are carried out at a temperature of 480° C. (900° F.) to 545° C. (1015° F.).

4. A method according to claim 1, wherein extrusion is carried out at a temperature of about 260° C. (500° F.) and said forging is carried out at a temperature in the range of about 260° C. (500° F.) up to about 370° C. (700° F.).

5. A method according to claim 1, wherein extrusion is carried out at a temperature of about 370° C. (700° F.) and said forging step is carried out at a temperature of about 260° C. (500° F.).

6. A method according to claim 1, wherein the extrusion is carried out at a temperature of at least 230° C. (450° F.).

7. A method according to claim 1, wherein said forged alloy is subjected to an aging treatment.

8. A method according to claim 1, wherein extrusion of the compaction billet is carried at an extrusion ratio of at least 3:1.

9. A method according to claim 1, wherein said dispersion strengthened alloy is comprised, by weight, of about 0.5 to about 4% lithium, about 0.5 up to about 7% magnesium, a small but effective amount for increased strength up to about 5% carbon, a small but effective amount for increased stability and strength up to about 1% oxygen, and the balance essentially aluminum, said alloy having a dispersoid content of a small but effective amount for increased strength and stability up to about 10% by volume.

10. A method according to claim 1, wherein said dispersion strengthened alloy is comprised, by weight, of about 1.5 to about 2.5% lithium, about 2 to about 4% magnesium and about 0.5 to about 2% carbon and less than about 1% oxygen, and the dispersoid content is about 3 to 6% by volume and said alloy in the forged condition has a yield strength of at least about 410 MPa (60 ksi) and elongation of at least 3%.

11. A forged product produced by the method of claim 1.

12. A forged product produced by the method of claim 10.

13. A dispersion strengthened alloy consisting essentially of, by weight, about 0.5 to about 4% lithium, about 0.5 to about 7% magnesium, a small but effective amount for increased strength up to about 5% carbon, a small but effective amount for increased stability and strength up to about 1% oxygen, and the balance essentially aluminum, said alloy being in the forged condition and produced by the process of claim 1.

14. A dispersion strengthened, mechanically alloyed aluminum-base alloy in the forged condition consisting essentially of, by weight, about 1.5 up to about 2.5% Li, about 2% up to about 4% Mg, about 0.5 to about 1.2% C and a small but effective amount up to about 1% O, said alloy having in the forged condition a YS of at least 410 MPa (60 ksi) and an elongation of at least 3%.

15. A dispersion strengthened, mechanically alloyed aluminum-base alloy of claim 14, wherein the lithium content is about 2.5% and the carbon content is at least 1%.

16. A dispersion strengthened, mechanically alloyed aluminum-base alloy of claim 14, wherein the lithium content is about 2.5% and the carbon content is less than 1%.

17. A dispersion strengthened, mechanically alloyed aluminum-base alloy of claim 14, wherein the lithium content is about 1.5%, the magnesium content about 4%.

18. A dispersion strengthened, mechanically alloyed aluminum-base alloy of claim 14, wherein the lithium content is about 1.75%, the magnesium content is about 4%.

19. A dispersion stengthened, mechanically alloyed aluminum-base alloy of claim 14, wherein the lithium content is about 2%, the magnesium content about 2%.

* * * * *